US005942475A

United States Patent [19]

Schlosberg et al.

[11] Patent Number: 5,942,475

[45] **Date of Patent: *Aug. 24, 1999**

[54] ENGINE OIL LUBRICANTS FORMED FROM COMPLEX ALCOHOL ESTERS

[75] Inventors: Richard H. Schlosberg, Bridgewater, N.J.; David Wayne Turner; Martin A. Krevalis, both of Baton Rouge, La.; Fay H. Gordon, Oxford; Ulrich Witten, Besselsliegh, both of United Kingdom

[73] Assignee: Exxon Chemical Patents Inc., Houston, Tex.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/797,369

[22] Filed: Feb. 7, 1997

Related U.S. Application Data

[60] Provisional application No. 60/025,596, Sep. 6, 1996.

[51] Int. Cl.[6] ..... C10M 129/78

[52] U.S. Cl. ..... 508/492; 508/485; 44/398

[58] Field of Search ..... 508/492, 485; 44/398

[56] References Cited

U.S. PATENT DOCUMENTS

| | | | |
|---|---|---|---|
| 2,628,974 | 2/1953 | Sanderson | 560/199 |
| 2,805,247 | 9/1957 | Krischai | 560/199 |
| 2,884,399 | 4/1959 | Barnart et al. | 524/285 |
| 3,016,353 | 1/1962 | Matuszak | 508/494 |
| 3,048,623 | 8/1962 | Matuszak et al. | 560/199 |
| 3,148,200 | 9/1964 | Mills et al. | 560/89 |
| 3,194,764 | 7/1965 | Ovist et al. | 508/492 |
| 3,202,701 | 8/1965 | Young et al. | 560/199 |
| 3,278,586 | 10/1966 | Ovist et al. | 560/199 |
| 3,360,546 | 12/1967 | Hequembourg | 560/191 |
| 3,377,377 | 4/1968 | Kluge | 560/199 |
| 3,697,428 | 10/1972 | Meinhardt et al. | 508/492 |
| 3,857,865 | 12/1974 | Sturwold et al. | 508/492 |
| 3,888,909 | 6/1975 | Dieterman et al. | 560/90 |
| 3,956,220 | 5/1976 | Riem et al. | 524/295 |
| 3,984,445 | 10/1976 | Takeo et al. | 554/131 |
| 4,036,771 | 7/1977 | Denis et al. | 508/494 |
| 4,155,861 | 5/1979 | Schmitt et al. | 508/492 |
| 4,968,452 | 11/1990 | Seiki | 508/485 |
| 4,994,196 | 2/1991 | Kagaya et al. | 508/485 |
| 5,057,247 | 10/1991 | Schmid et al. | 508/492 |
| 5,314,634 | 5/1994 | Kenbeek et al. | 508/492 |
| 5,372,736 | 12/1994 | Trivett | 252/56 |
| 5,411,672 | 5/1995 | Kagaya et al. | 508/492 |
| 5,503,762 | 4/1996 | Bongardt et al. | 508/492 |
| 5,560,850 | 10/1996 | Hoppe et al. | 508/485 |
| 5,562,867 | 10/1996 | Tiffany, III et al. | 44/398 |
| 5,658,863 | 8/1997 | Duncan et al. | 508/485 |
| 5,750,750 | 5/1998 | Duncan et al. | 554/117 |

FOREIGN PATENT DOCUMENTS

| | | |
|---|---|---|
| 736513 | 6/1966 | Canada . |
| 182526 | 5/1986 | European Pat. Off. . |
| 0335013 | 10/1989 | European Pat. Off. . |
| 0 568 348 | 11/1993 | European Pat. Off. . |
| 2307867 | 11/1976 | France . |
| 2511905 | 9/1975 | Germany . |
| 70004740 | 1/1965 | Japan . |
| 47-042821 | 10/1972 | Japan . |
| 60-045547 | 3/1985 | Japan . |
| 60-056657 | 3/1985 | Japan . |
| 62-045561 | 2/1987 | Japan . |
| 63-107947 | 5/1988 | Japan . |
| 03217493 | 9/1991 | Japan . |
| 05025484 | 2/1993 | Japan . |
| 06025682 | 2/1994 | Japan . |
| 06025683 | 2/1994 | Japan . |
| 7330670 | 12/1995 | Japan . |
| 6408397 | 1/1966 | Netherlands . |
| 1060750 | 3/1967 | United Kingdom . |
| 1460665 | 1/1977 | United Kingdom . |
| 1526825 | 10/1978 | United Kingdom . |
| 9617910 | 6/1996 | WIPO . |

OTHER PUBLICATIONS

A Route To Quantitative carbon–13 NMR Analysis Of Multicomponent Polyesters by Soeren Hvilsted; Makromol. Chem., Macromol. Symp. 1991, 177–184.

Carbon–13 NMR Analysis of Crosslinking Sites In Branched Polyesters by Soeren Hvilsted; Biol. Synth. Polym. Networks, 1988, 243–54.

Reactive Oligomers. 5. Polymerization of Ethylene Glycol Bis(isopropyl fumarate), ethylene glycol bis(n–butyl fumarate), and diethylene glycol bis(n–butyl fumarate by Akira Matsumoto et al.; J. Polym. Sci. Part a: Polym. Chem, 1988.

Reactive Oligomers. I. Preparation and Polymerization of Ethylene Glycol Bis(methyl fumarate); Akira Matsumoto et al.; J. Polym. Sci. Polym. Chem. Ed., 1983, 21(11).

Reactive Oligomers With Triple Bonds. II. Synthesis And Study of the Properties of Oligoester Propargyl Esters; S.G. Grigoryan et al; Am. Khim. Zh., 1979, 32(11), 911–14.

Effect of Number of Carboxyl Groups on Liquid Density of Esters of Alkylcarboxylic Acids; Joseph C. Phillips; J. Chem. Eng. Data, 1978, 23(1), 1–6.

Pyrolysis of poly(1,4–butylene adipatae); Francois Messier et al.; Can. J. Chem., 1977, 55(14).

(List continued on next page.)

*Primary Examiner*—Ellen M. McAvoy
*Attorney, Agent, or Firm*—Blossom E. Loo

[57] ABSTRACT

A crankcase engine lubricant which comprises the add mixture of the following components: (A) a lubricating oil which comprises the add mixture of the following components: a complex alcohol ester basestock and at least one additional basestock; and (B) an additive package; wherein the crankcase engine lubricant exhibits a percent fuel economy improvement in the range between about 0.3 to 5.0%, versus the lubricating oil without the complex alcohol ester basestock.

42 Claims, No Drawings

OTHER PUBLICATIONS

Correlation of Liquid Heat–Capacities for Carboxylic Esters; Joseph C. Phillips, et al.; J. Chem. Eng. Data, 1976 21(2), 228–32.
Liquid (melt) Heat Capacities and Heats of Vaporization of Oligomers of Poly(hesamethylene sebacate); J.C. Phillips; Polym. Eng. Sci., 1975, 15(2), 73–8.
Mass Spectra and Qualitative Analysis of Esters of Aliphatic Dicarboxylic Acids; L.N. Sosulina; Zh. Org. Khimm, 1974, 10(7), 1350–5.
Lubricants for Precision Mechanisms; A.K. Misra et al.; Proc. World Conf. Ind. Tribol., 1973.
New Lubricants. Esters and Polyesters of Pentaerythritol; Witold Pawlowski et al., Przem. Chem., 1974, 51(8).
Mixed Esters of 1,10–decanedicarboxylic acid; I.A. Volkova et al; Zh. Prikl, Khim. (Leningrad) 1972; 45(4).
Substances Contained in Polyesters of the System Triol–monool–dicarboxylic Acid; R. Schoellner; Plaste kaut, 1968, 15(3).
New Derivatives of Pentaerythritol; Bela Zsadon et al.; Magyar Kem. Folybiral 65, 253–6, 1959.
Light–switched Chromophoric Device Designed From an Ionophoric Calix[4]arene; Gang Deng et al.; J. Polym. Sci., Part a: Polym. Chem., 1993, 31(7).
Photoimaging Composition Containing Oligomer Maleic Acid Ester and Fumaric Acid Ester for Preparation of Relief Printing Plates; Joachim Gersdorf, Ger. Offen., 8 pp.
Mixed Esters for Plasticizers for Poly(vinyl chloride); Tetsu Matsumoto; Jpn. Kokai Tokkyo Koho, 7pp.
Diol Alkenyl Fumarates for Preparation of Highly Crosslinked Polymers; Tkayuki Otsu et al.; Jpn. Kokai Tokkyo Koho, 6.
Diol Bis(alkyl fumaate) Compounds; Masayoshi Oiwa; Jpn. Kokai Tokkyo Koho, 7 pp.
Polyol Poly(allylesters); Masaaki Oba et al.; Japan. Kokai, 4 pp.
Complex Ester Plasticizers and Lubricants; Tetsu Matsumoto; Jpn. Kokai Tokkyo Koho, 11 pp.
Effect of Small Amounts of the Plasticizer Propylene Glycol Adipate Dibutyl Ester on the High–speed Extrusion of Rigid PVC; H.R. Vargas et al.; Rev. Plast. Mod., 1986, 51(360).
Membrane Manufacturing Method; Inorganic Analytical Chemistry.
Refrigerator Working Fluid Compositions; Fossil Fuels, Derivatives and Related Products.
Liquid Compositions Containing Carboxylic (poly)esters; Industrial Organic Chemicals, Leather, Fats and Waxes.
Multisensor array for pH, Potassium(l+), sodium(1+) and calcium(2+) Measurements based on Coated–film Electrodes; Inorganic Analytical Chemistry.
Study of the Surface Activity of Dialkyl Disulfossuccinoethane Salts; Surface Active Agents and Detergents.
Multisensor Aray for pH, Potassium(1+); Sodium(1+) and Calcium(2+) Measurements Based on Coated–film Electrodes; Inorganic Analytical Chemistry.
Study of the Surface Activity of Dialkyl Disulfosuccionoethane Salts; Plastics Manufacture and Processing.
Polyester Plasticizers Containing Trimellitate Ester Mixtures; Plastics Manufacture and Processing.
Lubricants Containing Crosslinked Esters for Processing Thermoplastic Synthetic Fibers; Textiles and Fibers.
Lubricants Containing Ester–Olefin Reaction Products for Processing Thermoplastic Synthetic Fibers; Textiles and Fibers.
Lubricants Containing Ester Polymers for Processing Thermoplastic Synthetic Fibers; Textiles and Fibers.
Active Methylene Compounds and Receptors as Curing Systems for Coatings; Coatings, Inks, and Related Products.
Stretchable Polyethylene Films; Plastics Manufacture and Processing.
Potentiometric Method and Apparatus for Determining the Concentration Ratio of Lithium to Sodium Ions; Inorganic Analytical Chemistry.
Dicarboxylic Acid Diamides, Method for Producing Them, Their Sodium Complexes, and Ion–Selective Components for Determing Sodium Complexes; Inorganic Analytical Chemistry.
Photocured Polymers In Ion–selective Electrode Membranes, Part 1. A Potassium Electrode for Flow–Injection Analysis; Inorganic Analytical Chemistry.
Stabilizers for Halogen–containing Polymers Comprising the Product of a Diorganotin Oxide, an Ethylenically Unsaturated Dicarboxylic Acid Ester and a Mercaptan; Plastics Manufacture and Processing.
Esterification and/or Ester Interchange Catalyst; Industrial Organic Chemicals, Leather, Fats and Waxes.
Bicarbonate–sensitive Electrode Based on Planar Thin Membrane Technology; Inorganic Analytical Chemistry.
Selective transport Membranes and Their Applicability for Novel Sensors; Electrochemistry.
Design of Neutral Hydrogen Ion Carriers for Solvent Polymeric Membrane Electrodes of Selected pH Range; Inorganic Analytical Chemistry.
Radical Copolymerization of Ethylene Glycol Bis(methyl fumarate) with N–Vinylcarbazole; Chemistry of Synthetic High Polymers.
Stabilizers for PVC; Plastics Manufacture and Processing.
Bis(progargyloxymaleoyloxy)ethane as an Antiwear Additive for Spindle or Transformer Oil; Fossil Fuels, Derivatives, and Related Products.
Fiber Finishing Agents; Textiles.
Lubricant Finishes for Synthetic Fibers; Textiles.
Reactive Oligomers, II. Polymerization of Glycol (bis–allylphthalate)s and Glycol bis(allyl succinate)s; Chemistry of Synthetic High Polymers.
Synthesis of Vinyl Oligoesters; Chemistry of Synthetic High Polymers.
Easily Crosslinkable Polymer Material; Plastics Manufacture and Processing.
Readily–crosslinked Plastics; Plastics Manufacture and Processing.
Foam Plastics; Plastics Manufacture and Processing.
Synthesis of Unsaturated Polyesters Based on Dicyclopentadiene Derivatives; Plastics Manufacture and Processing.
Plasticizers for Vinyl Polymers and Nylon 12; Plastics Manufacture and Processing.
Poly(vinyl chloride) Mixture and Its Fcopolymers Resistant Against Organic Aliphatic Solvents, Oils and Low Temperature; Plastics Manufacture and Processing.
Effect of Polyester Plasticizers on the Radiation Crosslinking of a PVC–triallyl Cyanurate Composition; Plastics Manufacture and Processing.
Antifriction Grease; Petroleum, Petroleum Derivatives, and Related Products.
Light–resistant Polypropylene Filaments; Textiles.
2–Propynyl Bisesters; Noncondensed Aromatic Compounds.
Novel Polyallyl Esters, Their Production and Use; Plastics Manufacture and Processing.

Odorless Acrylic Adhesives; Plastics Fabrication and Uses.
Complex Esters As Antiwear Agents by Misra; et al., dated Apr. 26, 1973, pp. 229–237.
Journal of Applied Chemistry of the USSR; Sep., 1972, vol. 45, No. 4, Part 2; 3 pages.
Synthetic Lubricants And High–Performance Functional Fluids, by Ronald L. Shubkin, pp. 41 & 64.
Synthesis, Evaluation and Applications of Complex Esters As Lubricants: A Basic Study; by P.S. Venkataramani et al., JSL, pp. 271–289.

ENGINE OIL LUBRICANTS FORMED FROM COMPLEX ALCOHOL ESTERS

This application claims priority to U.S. Provisional Patent Application No. 60/025,596 filed Sep. 6, 1996.

The present invention relates generally to a method for improving the fuel economy of an internal combustion engine, and to crankcase lubricating oils which preferably comprise a blend of natural, hydrocarbon-based and/or synthetic lubricant oil with high viscosity complex alcohol esters. In particular, it relates to fully formulated engine oil which exhibits improved fuel economy performance due to the incorporation of a complex alcohol ester formed by reacting a polyol with a polycarboxylic acid or anhydride of a polycarboxylic acid, and a limited excess of monohydric alcohol, i.e., 0–20% excess alcohol, more preferably 0.5–15%, with other basestocks. These blended basestocks result in a percent fuel economy improvement increase in the range between about 0.5 to 5%, more preferably between about 0.5 to 3.5%.

BACKGROUND OF THE INVENTION

The constant threat of diminishing sources of fossil fuels and the resulting increases in prices for such fuels, coupled with the federally mandated requirements for reducing the amount of toxic emissions spewed into the atmosphere, has resulted in a great deal of interest in improving fuel economy, particularly the fuel economy of automobile combustion engines.

Such interest has led to the discovery of cleaner burning compositions, as well as to the discovery of a variety of fuel and/or engine lubricating oils compositions which result in improved fuel economy, i.e., a higher number of miles obtained in a given vehicle per U.S. gallon of fuel.

One such discovery, which is described in U.S. Pat. No. 4,584,112, involves lubricating the crankcase of an internal combustion engine with a lubricating oil composition consisting essentially of a hydrocarbon oil of lubricating viscosity, from 15 to 25 millimoles per kilogram of zinc O,O-di(2-ethylhexyl) phosphorodithioate, and from 0.25 to 2 wt. % of pentaerythritol monooleate.

U.S. Pat. No. 4,492,640 and U.S. Pat. No. 4,492,642 also describe methods for reducing the fuel consumption in internal combustion systems. Both of these patents described the addition to lubricating and/or fuel compositions used in an internal combustion engine of a friction reducing compound. The friction reducing compound disclosed in U.S. Pat. No. 4,492,640 comprises a boron derivative of a mixture of alkoxylated alcohols and hydroxyl sulfides, whereas the friction reducing compound disclosed in U.S. Pat. No. 4,492,642 comprises the product formed by reacting a borating agent with an ammoniated hydrocarbyl epoxide.

U.S. Pat. No. 4512903 discloses lubricating compositions which contain still other friction reducing compounds, namely, amides prepared from mono- or polyhydroxy substituted aliphatic monocarboxylic acids and primary or secondary amines.

U.S. Pat. No. 5,282,990 discloses a crankcase lubricating oil composition comprising an oil of lubricating viscosity and a synergistic blend of at least one compound (A) prepared by reaction an acid or a mixture of acids with a polyamine and at least one compound (B) prepared by reacting an acid or a mixture of acids with a polyol. That is, U.S. Pat. No. 528,990 generally discloses a lubricant additive concentrate comprising a lubricant oil and a synergistic blend of amine/amide and ester/alcohol friction modifying agents. This synergistic blend of friction modifying agents aids in the reduction of fuel consumption in an internal combustion engine.

Fuel economy improvement is a major driver in the performance of top of the line engine oils. At a given viscosity, changes in basestock composition can provide differences in fuel economy as measured by such tests as the Ford Sigma test and the M 111 test.

Engine oil manufacturers are attempting to change over by the year 2000 from engine oils which meet the ILSAC GF-2 specifications to a yet to be fully defined ILSAC GF-3 specification in order to reduce emissions, improve control system hardware protection, improve fuel economy and provide protection for extended drain intervals.

Lubricants in commercial use today are prepared from a variety of natural and synthetic basestocks admixed with various additive packages and solvents depending upon their intended application. Additive packages which include friction modifiers greatly affect the final cost and performance of the fully formulated lubricant. Therefore, it would be highly desirable to develop a lubricating oil for use in internal combustion engines which has a reduced level of additives, but provides the same or better fuel economy as lubricants with conventional amounts of such additives.

Lubricant basestocks used in internal combustion engine applications typically include mineral oils, highly refined mineral oils, polyalphaolefins (PAO), polyalkylene glycols (PAG), phosphate esters, silicone oils, diesters or polyol esters.

Synthetic lubricants provide a valuable alternative to natural lubricants (e.g., rapeseed oils, canola oils and sunflower oils) in a wide variety of applications. A preferred synthetic lubricant is neopolyol esters which are formed from the esterification of neopolyols and monocarboxylic acids. Thus, for example, use of neopolyols such as neopentyl glycol, trimethylolethane, trimethylolpropane, monopentaerythritol, technical grade pentaerythritol, dipentaerythritol, tripentaerythritol and the like can be esterified with carboxylic acids ranging from formic acid, acetic acid, propionic acid, up through long chain carboxylic acids both linear and branched. Typically, the acids employed range from $C_5$ to $C_{22}$.

One typical method of production of polyol esters would be to react a neopolyol with a carboxylic acid at elevated temperatures in the presence or absence of an added catalyst. Catalysts such as sulfuric acid, p-toluene sulfonic acid, phosphorous acid, and soluble metal esterification catalysts are conventionally employed.

While the method of production of neopolyol esters as outlined above is well known, the method produces materials with a set of standard properties. For a given combination of neopolyol and acid (or mixtures thereof) there is a set of product properties such as viscosity, viscosity index, molecular weight, pour point, flash point, thermal and oxidative stability, polarity, and biodegradability which are inherent to the compositions formed by the components in the recipe. To get out of the box of viscosity and other properties imposed by structure, attempts have been made to increase the viscosity of neopolyol esters by means of a second acid, a polybasic acid, in addition to, or instead of, the monocarboxylic acids described above. Thus, employing a polybasic acid such as, e.g., adipic acid, sebacic acid, azelaic acid and/or acid anhydrides such as, succinic, maleic and phthalic anhydride and the like enables one to have the components of a polymeric system when reacted with a neopolyol. By adding a poly- or di-basic acid to the mix, one is able to achieve some degree of cross-linking or oligomerization, thereby causing molecular size growth such that the overall viscosity of the system is increased. Higher viscosity oils are desirable in certain end use application such as greases, heavy duty engine oils, certain hydraulic fluids and the like.

Other conventional natural and synthetic esters may each provide one or more of the desired attributes, e.g., high viscosity, good low temperature properties, biodegradability, lubricity, seal compatibility, low toxicity, and good thermal and oxidative stability, but none appears to be able to meet all of the product attributes by themselves. Similarly, the natural basestocks such as rapeseed oil are capable of meeting the biodegradability and toxicity properties, but fail to meet the required high viscosity, lubricity, and thermal and oxidative stability properties. Moreover, none of the conventional engine lubricating oils discussed above appear to positively affect the percent fuel economy improvement such that the lubricant will meet or exceed the proposed GF-3 specifications. In order for the conventional lubricating oils to at least meet the proposed GF-3 specification, it will be required to increase the levels of various additives, such as friction modifiers and molybdenum, at a substantial increase in cost to the manufacturer.

The blended lubricant basestocks according to the present invention comprising a complex alcohol ester and at least one additional natural or synthetic basestock appears to satisfy all of the desired attributes for fully formulated lubricant basestocks by providing the basestock with effective lubricating properties such that it meets or exceeds the proposed lubricant GF-3 specifications, while substantially increasing the percent fuel economy improvement. They also provide excellent thermal and oxidative stability, good low temperature properties (i.e., low pour points), low toxicity, low volatility, and good seal compatibility.

The present inventors believe that the use of the unique complex alcohol ester basestocks together with conventional natural, hydrocarbon-based and/or other synthetic oil basestocks in lubricating internal combustion engines results in dramatically increased percent fuel economy improvements, while meeting or exceeding all of the viscosity and volatility requirements of the proposed GF-3 specification, is due to the fact that the complex alcohol ester basestock of the present invention is more likely than natural, hydrocarbon-based and/or other synthetic oils to find its way to the surface. Since the complex alcohol ester is a stable fluid at the surface, it is able to provide protection from metal-to-metal contact which manifests itself in the form of friction metal wear and heat loss. This friction metal wear contributes to reduced fuel economy. Solubility of mogas components in the lubricant leads to unburned fuel and higher emissions. The polarity of the unique complex alcohol ester compositions according to the present invention is such that less hydrocarbon is trapped in the oil, thereby reducing emissions.

Moreover, the complex alcohol esters of the present invention eliminate the necessity of adding costly molybdenum to the lubricating oil in order to satisfy the percent fuel economy improvement which is required under the proposed GF-3 specifications. To the contrary, if conventional molybdenum additives are added to the lubricating oil comprising complex alcohol esters the data set forth herein clearly demonstrates that the resulting product has reduced percent fuel economy improvement than lubricating oils using complex alcohol esters or molybdenum alone. It is believed that the molybdenum and complex alcohol esters compete for surface cites, thus reducing the effect on the friction and wear performance of the lubricating oil.

The complex alcohol esters with low polybasic acid ester content according to the present invention are formed by using no more than 20% excess alcohol during the reaction step. Furthermore, the present inventors have discovered that these unique complex alcohol esters according to the present invention can also be formed such that they have low metals and acid content by treating the crude reactor product with water at elevated temperatures and pressures greater than one atmosphere. That is, the present inventors have unexpectedly discovered that high temperature hydrolysis can be used to remove a substantial portion of the metal catalyst from the complex alcohol ester reaction product without any significant increase in the total acid number of the resulting product. Low metals and low acid number are important because both can catalyze the hydrolysis of the ester during end-use.

Moreover, the present inventors have also demonstrated that an unexpected, synergistic effect occurs when these complex alcohol esters of the present invention are blended with either a natural, hydrocarbon-based or synthetic ester basestock, i.e., the blended basestock unexpectedly exhibits enhanced product attributes versus either the complex alcohol ester or other basestock by itself. Thus, the blended basestocks according to the present invention exhibit the following attributes: percent fuel economy improvement, excellent lubricity, seal compatibility, low toxicity, good thermal and oxidative stability, a wide viscosity range to meet various iso grade needs, and improved engine performance.

SUMMARY OF THE INVENTION

A crankcase engine lubricant which comprises the add mixture of the following components: (A) a lubricating oil which comprises the add mixture of the following components: a complex alcohol ester basestock and at least one additional basestock; and (B) an additive package; wherein the crankcase engine lubricant exhibits a percent fuel economy improvement in the range between about 0.3 to 5.0%, versus the lubricating oil without the complex alcohol ester basestock.

The unique complex alcohol ester basestock according to the present invention preferably comprises the reaction product of an add mixture of the following: (1) a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; (2) a polybasic acid or an anhydride of a polybasic acid, provided that the ratio of equivalents of the polybasic acid to equivalents of alcohol from the polyhydroxyl compound is in the range between about 1.6:1 to 2:1; and (3) a monohydric alcohol, provided that the ratio of equivalents of the monohydric alcohol to equivalents of the polybasic acid is in the range between about 0.84:1 to 1.2:1; wherein the complex alcohol ester exhibits a viscosity in the range between about 100–700 cSt at 40° C., preferably 100–200 cSt, and has a polybasic acid ester concentration of less than or equal to 70 wt. %, based on the complex alcohol ester.

The complex alcohol ester basestock is typically added in an amount such that the lubricating oil exhibits a lubricity, as measured by the coefficient of friction, of less than or equal to 0.15.

Moreover, the complex alcohol ester preferably exhibits the following properties: lubricity, as measured by the coefficient of friction, of less than or equal to 0.1; a pour point of less than or equal to −20° C., preferably less than or equal to −40°; biodegradability of greater than 60%, as measured by the Sturm test; an aquatic toxicity of greater than 1,000 ppm; no volatile organic components; and thermal/oxidative stability as measured by HPDSC at 220° C. and 3.445 MPa air of greater than 10 minutes with about 0.5 wt. % of an antioxidant such as Vanelube™ 81.

This unique lubricating oil passes the Yamaha Tightening Test, exhibits a FZG of greater than about 12, and/or exhibits a wear scar diameter of less than or equal to 0.45 millimeters.

The additional basestock is typically selected from the group consisting of: natural oils, hydrocarbon-based oils and synthetic oils.

The complex alcohol ester basestock is present in an amount between about 0.5–35 wt. %, preferably 1–15 wt. %, and the additional basestock is present in an amount between about 65–99.5 wt. %, preferably 85–95 wt. %.

In accordance with a preferred embodiment, the polyhydroxyl compound is at least one compound selected from the group consisting of: technical grade pentaerythritol and mono-pentaerythritol, and the ratio of equivalents of the polybasic acid to equivalents of alcohol from the polyhydroxyl compound is in the range between about 1.75:1 to 2:1.

Another embodiment includes a polyhydroxyl compound from the group consisting of: trimethylolpropane, trimethylolethane and trimethylolbutane, and a ratio of equivalents of the polybasic acid to equivalents of alcohol from the polyhydroxyl compound is in the range between about 1.6:1 to 2:1.

Still another embodiment includes a polyhydroxyl compound is di-pentaerythritol and a ratio of equivalents of the polybasic acid to equivalents of alcohol from the polyhydroxyl compound is in the range between about 1.83:1 to 2:1.

The complex alcohol ester basestock according to the present invention preferably exhibits at least one additional property selected from the group consisting of: (a) a total acid number of less than or equal to about 1.0 mgKOH/gram, (b) a hydroxyl number in the range between about 3 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, and (i) a specific gravity of less than about 1.0, (j) a viscosity index equal to or greater than about 150.

When the additional basestock is a synthetic oil, then the lubricating oil exhibits a percent fuel economy improvement of less than or equal to 3.5%, versus the lubricating oil without the complex alcohol ester basestock.

However, when the additional basestock is the hydrocarbon-based oil, then the lubricating oil exhibits a percent fuel economy improvement of between about 0.5 to 1.5%, versus the lubricating oil without the complex alcohol ester basestock.

The present invention also encompasses a process for improving the fuel economy of a vehicle powered by an internal combustion engine having a crankcase, which comprises: adding to the crankcase a lubricating oil which comprises the add mixture of the following components: a complex alcohol ester basestock and at least one additional basestock; and operating the internal combustion engine wherein the lubricating basestock oil exhibits a percent fuel economy improvement in the range between about 0.3 to 5.0%, versus the lubricating oil without the complex alcohol ester basestock.

The crankcase engine oil for use in preparing lubricating compositions of the present invention include those conventionally employed as crankcase lubricating oils for spark-ignited and compression-ignited internal combustion engines, such as automobile and truck engines, marine and railroad diesel engines, and the like.

DESCRIPTION OF THE PREFERRED EMBODIMENTS

Complex alcohol esters provide effective lubricating properties. They also provide excellent stability and high viscosity. These complex alcohol esters exhibit excellent lubricity, seal compatibility, low toxicity, friction modification, viscosity, stability and improved engine performance. The present inventors have discovered that these unique complex alcohol esters, when blended with other natural, hydrocarbon-based and/or synthetic basestocks, result in a lubricant basestock which unexpectedly exhibits percent fuel economy improvements, versus conventional engine oil basestocks without these unique complex alcohol esters.

That is, when crankcase lubricating oil basestocks comprise a blend of complex alcohol ester and hydrocarbon-based oils, e.g., mineral oils or highly refined mineral oils, the percent fuel economy improvement is less than or equal to about 5.0%, preferably in the range between about 0.3 to 5.0%, versus the same basestock without the complex alcohol ester component. However, a lubricating oil basestock comprising a blend of complex alcohol ester and a synthetic oil basestock selected from the group consisting of: polyalphaolefins, polyalkylene glycols, polyisobutylenes, phosphate esters, silicone oils, diesters and polyol esters exhibits a percent fuel economy improvement of less than or equal to 3.5%, versus the same basestock without the complex alcohol ester component.

That is, the blended basestocks exhibit a lubricity, as measured by the coefficient of friction, of less than or equal to 0.15.

The preferred lubricant according to the present invention is a blend of the described complex alcohol ester composition and at least one additional basestock selected from the group consisting of: hydrocarbon-based oils (e.g., mineral oils and highly refined mineral oils), synthetic oils (e.g., polyalphaolefins, polyalkylene glycols, polyisobutylenes, phosphate esters, silicone oils, diesters, and polyol esters), and natural oils (e.g., rapeseed oil, canola oils and sunflower oils); and a lubricant additive package. Blended lubricants according to the present invention preferably include 1–35 wt. % complex alcohol ester and 65–99 wt. % additional basestock.

The complex alcohol ester may preferably be blended with synthetic base oils such as alkyl esters of dicarboxylic acids, polyglycols and alcohols, polyalphaolefins, alkyl benzenes, organic esters of phosphoric acids, polysilicone oils, etc.

The hydrocarbon-based oils typically include mineral oils and highly refined mineral oils. The mineral lubricating oils which may vary widely as to their crude source, e.g., whether paraffinic, naphthenic, mixed, paraffinic-naphthenic, and the like, as well as to their formation, e.g., distillation range, straight run or cracked, hydrofined, solvent extracted and the like. The synthetic oils typically include polyalphaolefins, polyalkylene glycols, polyisobutylenes, phosphate esters, silicone oils, diesters, and polyol esters. The natural oils typically include rapeseed oil, canola oils and sunflower oils.

More specifically, the hydrocarbon-based lubricating oil basestocks which can be used in the compositions of this invention may be straight mineral lubricating oil or distillates derived from paraffinic, naphthenic, asphaltic, or mixed base crudes. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, molecular sieves, etc.

COMPLEX ALCOHOL ESTERS

The complex alcohol ester basestock according to the present invention preferably comprises the reaction product of an add mixture of the following: (1) a polyhydroxyl compound represented by the general formula:

$$R(OH)_n$$

wherein R is any aliphatic or cyclo-aliphatic hydrocarbyl group and n is at least 2, provided that the hydrocarbyl group contains from about 2 to 20 carbon atoms; (2) a polybasic acid or an anhydride of a polybasic acid, provided that the ratio of equivalents of the polybasic acid to equivalents of alcohol from the polyhydroxyl compound is in the range between about 1.6:1 to 2: 1; and (3) a monohydric alcohol, provided that the ratio of equivalents of the monohydric alcohol to equivalents of the polybasic acid is in the range between about 0.84:1 to 1.2:1; wherein the complex alcohol ester exhibits a viscosity in the range between about 100–700 cSt at 40° C., preferably 100–200 cSt, and has a polybasic acid ester concentration of less than or equal to 70 wt. %, based on the complex alcohol ester.

The present inventors have unexpectedly discovered that if the ratio of polybasic acid to polyol (i.e., polyhydroxyl compound) is too low, then an unacceptable amount of cross-linking occurs which results in very high viscosities, poor low temperature properties, poor biodegradability, and poor compatibility with other basestocks and with additives. If, however, the ratio of polybasic acid to polyol is too high, then an unacceptable amount of polybasic acid ester (e.g., adipate di-ester) is formed resulting in poor seal compatibility and low viscosity which limits the complex alcohol ester's applicability.

The present inventors have also discovered that if the ratio of monohydric alcohol to polybasic acid is too low, i.e., less than 0.96 to 1, then an unacceptably high acid number, sludge concentration, deposits, and corrosion occur. If, however, the ratio of monohydric alcohol to polybasic acid is too high (i.e., 1.2 to 1), then an unacceptable amount of polybasic acid ester is formed resulting in poor seal compatibility and low viscosity which limits the complex alcohol ester's applicability.

Moreover, the complex alcohol ester preferably exhibits the following properties: lubricity, as measured by the coefficient of friction, of less than or equal to 0.1; a pour point of less than or equal to −20° C., preferably less than or equal to −40°; biodegradability of greater than 60%, as measured by the Sturm test; an aquatic toxicity of greater than 1,000 ppm; no volatile organic components; and thermal/oxidative stability as measured by HPDSC at 220° C. and 3.445 MPa air of greater than 10 minutes with about 0.5 wt. % of an antioxidant such as Vanelube™ 81.

One preferred complex alcohol ester basestock includes a polyhydroxyl compound selected from the group consisting of: technical grade pentaerythritol and mono-pentaerythritol, and has a ratio of equivalents of the polybasic acid to equivalents of alcohol from the polyhydroxyl compound is in the range between about 1.75:1 to 2:1.

A second preferred complex alcohol ester basestock includes a polyhydroxyl compound selected from the group consisting of: trimethylolpropane, trimethylolethane and trimethylolbutane, and has a ratio of equivalents of the polybasic acid to equivalents of alcohol from the polyhydroxyl compound is in the range between about 1.6:1 to 2:1.

A third preferred complex alcohol ester basestock includes a polyhydroxyl compound is di-pentaerythritol and has a ratio of equivalents of the polybasic acid to equivalents of alcohol from the polyhydroxyl compound is in the range between about 1.83:1 to 2:1.

The complex alcohol ester basestock according to the present invention preferably exhibits at least one additional property selected from the group consisting of: (a) a total acid number of less than or equal to about 1.0 mgKOH/gram, (b) a hydroxyl number in the range between about 3 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, and (i) a specific gravity of less than about 1.0, (j) a viscosity index equal to or greater than about 150.

These complex alcohol ester basestocks preferably exhibit good lubricity, as measured by the coefficient of friction, of less than or equal to 0.1.

It is preferable that the polybasic acid is adipic acid and the branched monohydric alcohol is either isodecyl alcohol or 2-ethylhexyl alcohol.

Complex alcohol esters are produced by the esterification of polyols with dibasic acids and "end-capped" with monohydric alcohols in either single step or two step reactions. Catalysts are typically used to achieve greater than 99% conversion of the acid functionality present. Metal catalysts are preferred for several reasons, but have a disadvantage in that metallic residues are left in the final product after conventional removal techniques are used. The processes proposed herein use metal catalysts, but avoid the presence of significant amounts of metals in the final product and maintaining a low TAN, by either (1) adding the catalyst to the reaction after about 88 to 92% conversion of the polybasic acid is achieved rather than at the start of the reaction or, preferably, (2) treating the crude esterification product (after 99.8% of the hydroxyl functionalities are esterified) with water in an amount of between about 0.5 to 4 wt. %, based on crude esterification product, more preferably between about 2 to 3 wt. %, at elevated temperatures of between about 100 to 200° C., more preferably between about 110 to 175° C., and most preferably between about 125 to 160° C., and pressures greater than one atmosphere.

The process used to form the complex alcohol ester according to the present invention includes the following steps wherein a polyol and monohydric alcohol are reacted with a polycarboxylic (polybasic) acid or an anhydride of a polycarboxylic acid. For each hydroxyl group on the polyol, approximately one mole of polycarboxylic acid is used in the reaction mixture. Enough monohydric alcohol (e.g., less than 20%, excess, more preferably between about 5–10% excess, based on amounts necessary to fully esterify the polybasic acid, is used to react with all of the carboxylic acid groups after that the polyol also reacts with these acid groups. The esterification reaction can take place with or without a sulfuric acid, phosphorus acid, sulfonic acid, para-toluene sulfonic acid or titanium, zirconium or tin-based catalyst, at a temperature in the range between about 140 to 250° C. and a pressure in the range between about 30 mm Hg to 760 mm Hg (3.999 to 101.308 kPa) for about 0.1 to 16 hours, preferably 2 to 12 hours, most preferably 6 to 8 hours. The stoichiometry in the reactor is variable, and vacuum stripping of excess alcohol generates the preferred final composition.

Optional steps include the following:

(a) addition of adsorbents such as alumina, silica gel, activated carbon, clay and/or filter aid to the reaction mixture following esterification before further treatment, but in certain cases clay treatment may occur later in the process following either flash drying or steam or nitrogen stripping and in still other cases the clay may be eliminated from the process altogether;

(b) addition of water in an amount of between about 0.5 to 4 wt. %, based on crude esterification product, more preferably between about 2 to 3 wt. %, to hydrolyze the catalyst at elevated temperatures of between about 100 to 200° C., more preferably between about 110 to 175° C., and most preferably between about 140 to 160° C., and pressures greater than one atmosphere, optionally, base to neutralize the residual organic and inorganic acids, and, optionally, addition of activated carbon during hydrolysis;

(c) removal of the water used in the hydrolysis step by heat and vacuum in a flash step;

(d) filtration of solids from the ester mixture containing the bulk of the excess alcohol used in the esterification reaction;

(e) removal of excess alcohol by steam stripping or any other distillation method and recycling of the alcohol within the esterification process; and (f) removing any residual solids from the stripped ester in a final filtration.

The esterification process as described above allows for the formation of an ester product having low metals (i.e., approximately less than 25 ppm metals based on the total ester product), low ash (i.e., approximately less than 40 ppm ash based on the total ester product), and low total acid number (TAN) (i.e., approximately less than or equal to 1.0 mg KOH/gram).

It is also desirable to form a complex alcohol ester using the one-step esterification process set forth above having an average molecular weight in the range between about 270 to greater than 250,000 Daltons (atomic weight units).

When it is desirable to use esterification catalysts, titanium, zirconium and tin-based catalysts such as titanium, zirconium and tin alcoholates, carboxylates and chelates are preferred. See U.S. Pat. No. 3,056,818 (Werber) and U.S. Pat. No. 5,324,853 (Jones et al.) which disclose various specific catalysts which may be used in the esterification process of the present invention and which are incorporated herein by reference. It is also possible to use sulfuric acid, phosphorus acid, sulfonic acid and para-toluene sulfonic acid as the esterification catalyst, although they are not as preferred as the metal catalysts discussed immediately above, since they are very difficult to remove by conventional methods from this product.

It is particularly desirable to be able to control the stoichiometry in such a case so as to be able to manufacture the same product each time. Further, one wants to obtain acceptable reaction rates and to obtain high conversion with low final acidity and low final metals content. The present inventors have synthesized a composition and a method of production of that composition which provides a high viscosity oil having good low temperature properties, low metals, low acidity, and high viscosity index.

One preferred manufacturing process using a batch process is as follows: (1) charge a polyol, polybasic acid and monohydric alcohol into an esterification reactor; (2) raise the temperature of the reacting mass to 220° C., while reducing vacuum to cause the alcohol present to boil and then separating water from the overhead vapor stream and returning alcohol to the reactor; (3) add tetraisopropyl titanate catalyst to the reacting mixture between 88 to 92% of the acid functionalities present in polybasic acid have been esterified; (4) continue reaction to about 99% conversion or other desired level of conversion of the acid functionalities present in polybasic acid; (5) stop the reaction by removing vacuum and heat; (6) carbon treat the product, if necessary to reduce its color; (7) hydrolyze titanium catalyst in the crude reactor product with about 0.5 to 4 wt. % water at a temperature in the range between about 100 to 200° C. and a pressure of above 1 atmosphere; (8) filter carbon the titanium catalyst residue; and (9) strip unreacted excess monohydric alcohol from the crude product.

The present inventors have discovered that under certain highly specific conditions, the amount of titanium in the product can be reduced to a level below 25 ppm using the above process. The process employed to make low residual titanium complex alcohol esters requires a minimum residence time of titanium in the reactor at certain temperatures (ca. 220° C.), the minimum amount of titanium catalyst required to assure the required conversion levels, and very effective contacting and mixing with the hydrolysis water solution employed to convert the organo titanium species to insoluble titanium dioxide.

Alternatively, if a product completely free of metals is desired, the process can be terminated at some conversion before the point at which (90% conversion of polybasic acid) the titanium catalyst is added in the above approach.

Of particular interest is the use of certain oxo-alcohols as finishing alcohols in the process of production of the desired materials. One particularly preferred oxo-alcohol is isodecyl alcohol, prepared from the corresponding $C_9$ olefin. When the alcohol is isodecyl alcohol, the polyol is trimethylolpropane and the acid is the $C_6$ diacid, e.g. adipic acid, a preferred complex alcohol ester is attained. The present inventors have surprisingly discovered that this complex alcohol ester, wherein the alcohol is a branched oxo-alcohol has a surprisingly high viscosity index of ca. 150 and is surprisingly biodegradable as defined by the Modified Sturm test. This complex alcohol ester can be prepared with a final acidity (TAN) of less than 1.0 mg KOH/gram and with a conversion of the adipic acid of greater than 99%. In order to achieve such a high conversion of adipic acid, a catalyst is required, and further, it is preferable to add the catalyst within a relatively narrow conversion window. Alternatively, the present inventors have discovered that the catalyst can also be added at anytime during the reaction product and removed to an amount of less than 25 ppm and still obtain a final acidity (TAN) of less than 1.0 mg KOH/gram, so long as the esterification reaction is followed by a hydrolysis step wherein water is added in an amount of between about 0.5 to 4 wt. %, based on crude esterification product, more preferably between about 2 to 3 wt. %, at elevated temperatures of between about 100 to 200° C., more preferably between about 110 to 175° C., and most preferably between about 140 to 160° C., and pressures greater than one atmosphere. Such high temperature hydrolysis can successfully remove the metals to less than 25 ppm without increasing the TAN to greater than 1.0 mg KOH/gram. The low metals and low acid levels achieved by use of this novel high temperature hydrolysis step is completely unexpected.

The present inventors have also found that the preferred product composition is attained only when the titanium is added between 80 to 93% conversion. Further, the present inventors have discovered that the actual product is a broad mix of molecular weights of esters and that, if so desired, an amount of diisodecyl adipate can be removed from the higher molecular weight ester via wipe film evaporation or other separation techniques if desired.

It is known that when titanium (or other metal catalysts such as tin) are used in the manufacture of a sterically hindered, crowded neopolyol ester, removal of the metal via hydrolysis is difficult to achieve. Thus, for example, when titanium is added prior to approximately 90% conversion of the polybasic acid without high temperature hydrolysis, then significant levels, i.e., greater than 25 ppm, of titanium metal are typically found in the final product even after extensive efforts to hydrolyze the organic titanium to titanium dioxide at conventional hydrolysis temperatures and subsequent removal via filtration.

The present inventors have also discovered that highly stable complex alcohol esters can be produced that are resistant to viscosity increases during heating. This is accomplished by synthesizing complex alcohol esters with a low hydroxyl number by limiting the ratio of polybasic acid, polyol and monohydric alcohol. These highly stable complex alcohol esters exhibit no increase in viscosity when heated to temperatures above 200° C., while similar esters with high hydroxyl numbers increase in viscosity from 5 to 10% under similar conditions. The preferred hydroxyl number according to the present invention is between about 3 to 50 (mg KOH/gram).

MONOHYDRIC ALCOHOLS

Among the alcohols which can be reacted with the diacid and polyol are, by way of example, any $C_5$ to $C_{13}$ branched and/or linear monohydric alcohol selected from the group consisting of: isopentyl alcohol, isohexal alcohol, isoheptyl alcohol, n-heptyl alcohol, iso-octyl alcohol (e.g., 2-ethyl hexanol or Exxal™ 8), n-octyl alcohol, iso-nonyl alcohol (e.g., 3,5,5-trimethyl-1-hexanol or Exxal™ 9), n-nonyl alcohol, isodecyl alcohol, and n-decyl alcohol; provided that the amount of linear monohydric alcohol is present in the range between about 0–20 mole %, based on the total amount of monohydric alcohol.

The linear monohydric alcohol is present in an amount between about 0 to 30 mole %, preferably between about 5 to 20 mole %.

One preferred class of monohydric alcohol is oxo alcohol. Oxo alcohols are manufactured via a process, whereby propylene and other olefins are oligomerized over a catalyst (e.g., a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

The branched oxo alcohols are preferably monohydric oxo alcohols which have a carbon number in the range between about $C_5$ to $C_{13}$. The most preferred monohydric oxo alcohols according to the present invention include iso(oxo)octanol, e.g., Exxal™ 8 alcohol, formed from the cobalt oxo process and 2-ethylhexanol which is formed from the rhodium oxo process.

The term "iso" is meant to convey a multiple isomer product made by the oxo process. It is desirable to have a branched oxo alcohol comprising multiple isomers, preferably more than 3 isomers, most preferably more than 5 isomers.

Branched oxo alcohols may be produced in the so-called "oxo" process by hydroformylation of commercial branched $C_4$ to $C_{12}$ olefin fractions to a corresponding branched $C_5$ to $C_{13}$ alcohol/aldehyde-containing oxonation product. In the process for forming oxo alcohols it is desirable to form an alcohol/aldehyde intermediate from the oxonation product followed by conversion of the crude oxo alcohol/aldehyde product to an all oxo alcohol product.

The production of branched oxo alcohols from the cobalt catalyzed hydroformylation of an olefinic feedstream preferably comprises the following steps:

(a) hydroformylating an olefinic feedstream by reaction with carbon monoxide and hydrogen (i.e., synthesis gas) in the presence of a hydroformylation catalyst under reaction conditions that promote the formation of an alcohol/aldehyde-rich crude reaction product;

(b) demetalling the alcohol/aldehyde-rich crude reaction product to recover therefrom the hydroformylation catalyst and a substantially catalyst-free, alcohol/aldehyde-rich crude reaction product; and (c) hydrogenating the alcohol/aldehyde-rich crude reaction product in the presence of a hydrogenation catalyst (e.g., massive nickel catalyst) to produce an alcohol-rich reaction product.

The olefinic feedstream is preferably any $C_4$ to $C_{12}$ olefin, more preferably branched $C_7$ to $C_9$ olefins. Moreover, the olefinic feedstream is preferably a branched olefin, although a linear olefin which is capable of producing all branched oxo alcohols is also contemplated herein. The hydroformylation and subsequent hydrogenation in the presence of an alcohol-forming catalyst, is capable of producing branched $C_5$ to $C_{13}$ alcohols, more preferably branched $C_8$ alcohol (i.e., Exxal 8), branched $C_9$ alcohol (i.e., Exxal 9) and iso-decyl alcohol. Each of the branched oxo $C_5$ to $C_{13}$ alcohols formed by the oxo process typically comprises, for example, a mixture of branched oxo alcohol isomers, e.g., Exxal 8 alcohol comprises a mixture of 3,5-dimethyl hexanol, 4,5-dimethyl hexanol, 3,4-dimethyl hexanol, 5-methyl heptanol, 4-methyl heptanol and a mixture of other methyl heptanols and dimethyl hexanols.

Any type of hydrogenation catalyst known to one of ordinary skill in the art which is capable of converting oxo aldehydes to oxo alcohols is contemplated by the present invention.

POLYOLS

Among the polyols (i.e., polyhydroxyl compounds) which can be reacted with the diacid and monohydric alcohol are those represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, trimethylolethane, trimethylolpropane, trimethylolbutane, mono-pentaerythritol, technical grade pentaerythritol, and di-pentaerythritol. The most preferred alcohols are technical grade (e.g., approximately 88% mono-, 10% di- and 1–2% tri-pentaerythritol) pentaerythritol, monopentaerythritol, di-pentaerythritol, and trimethylolpropane.

POLYBASIC ACIDS

Selected polybasic or polycarboxylic acids include any $C_2$ to $C_{12}$ diacids, e.g., adipic, azelaic, sebacic and dodecanedioic acids.

ANHYDRIDES

Anhydrides of polybasic acids can be used in place of the polybasic acids, when esters are being formed. These include succinic anhydride, glutaric anhydride, adipic anhydride, maleic anhydride, phthalic anhydride, nadic anhydride, methyl nadic anhydride, hexahydrophthalic anhydride, and mixed anhydrides of polybasic acids.

The complex alcohol ester composition according to the present invention can be used in the formulation of various lubricants, such as, crankcase engine oils (i.e., passenger car motor oils, heavy duty diesel motor oils, and passenger car diesel oils). The lubricating oils contemplated for use with the polyol ester compositions of the present invention include both mineral and synthetic hydrocarbon oils of lubricating viscosity and mixtures thereof with other synthetic oils. The synthetic hydrocarbon oils include long chain alkanes such as cetanes and olefin polymers such as oligomers of hexene, octene, decene, and dodecene, etc. The other synthetic oils include (1) fully esterified ester oils, such as pentaerythritol esters of monocarboxylic acids having 2 to 20 carbon atoms or trimethylol propane esters of monocarboxylic acids having 2 to 20 carbon atoms, (2) polyacetals and (3) siloxane fluids. Especially useful among the synthetic esters are those made from polycarboxylic acids and monohydric alcohols.

In some of the lubricant formulations set forth above a solvent may be employed depending upon the specific application. Solvents that can be used include the hydrocarbon solvents, such as toluene, benzene, xylene, and the like.

In the reaction to form esters the monohydric alcohol, a branched or unbranched $C_5$–$C_{13}$ alcohol (most preferably isodecyl alcohol or 2-ethylhexyl alcohol), is typically present in an excess of about 10 to 20 mole % or more. The excess monohydric alcohol is used to force the reaction to completion. The composition of the feed acid is adjusted so as to provide the desired composition of the ester product. After the reaction is complete, the excess monohydric alcohol is removed by stripping and additional finishing.

CRANKCASE LUBRICATING OILS

The basestock blend can be used in the formulation of crankcase lubricating oils (i.e., passenger car motor oils, heavy duty diesel motor oils, and passenger car diesel oils) for spark-ignited and compression-ignited engines. The preferred crankcase lubricating oil is typically formulated using the basestock blend formed according to the present invention together with any conventional crankcase additive package. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier[1] | 0.01–6 | 0–4 |
| Basestock Blend | Balance | Balance |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 15 mass % and preferably 5 to 10 mass %, typically about 7 to 8 mass % of the concentrate or additive package with the remainder being basestock.

All of the weight percents expressed herein are based on active ingredient (A.I.) content of the additive, and/or upon the total weight of any additive package, or formulation which will be the sum of the A.I. weight of each additive plus the weight of total oil or diluent.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralized detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with P2S5 and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of basestocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK-A-1560830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP-A-330522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

A preferred lubricating engine oil according to the present invention is a blend of mineral oil and a complex alcohol ester, wherein the complex alcohol ester is present in an amount between about 1–15 wt. %, preferably between 1–10 wt. %, and the mineral oil is present in an amount between about 85–99 wt. %, preferably between 90–99 wt. %. The preferred additive package comprises the following:: dispersant, diluent, detergent, copper complex, amine antioxidant, phenolic antioxidant, molybdenum dithiocarbamate, and ZDDP.

EXAMPLE 1

A complex alcohol ester is formed according to the present invention by reacting 1.0 mole of trimethylol propane, 2.75 moles of adipic acid, and 3.025 moles of isodecyl alcohol. The temperature of the reaction mixture is raised to 220° C. while reducing the vacuum to cause the alcohol present to boil. Water is concurrently separated from the overhead vapor stream produced, and dried alcohol is returned to the reactor. Tetraisopropyl titanate catalyst is added to the reacting mixture when 90% of the acid functionalities present in the adipic acid have been esterified. The reaction is continued to 99.8% conversion of the acid functionalities present in adipic acid. The reaction is brought to a stop by removing the vacuum and heat. The product is carbon treated to reduce its color, and the titanium catalyst is hydrolyzed in the crude reactor product with 2 wt. % water. The carbon and hydrolyzed titanium catalyst residue are filtered and unreacted excess isodecyl alcohol is stripped from the crude product. Accordingly, the amount of titanium in the product can be reduced to a level below 25 ppm using this process.

The resultant complex alcohol ester has a surprisingly high viscosity index of ca. 150 and is surprisingly biodegradable as defined by the Modified Sturm test. This complex alcohol ester has a final acidity (TAN) of less than 2 mg KOL/gram.

EXAMPLE 2

To produce a product according to the present invention that is substantially free of metal catalysts (i.e., less than 25 ppm), the process of Example 1 is employed, however the process is terminated at a conversion point (e.g. 89%) before the titanium catalyst is added according to Example 1.

EXAMPLE 3

The complex alcohol esters set forth in Table 1 below were each tested for miscibility and stability. The stability data are set forth in Table 2 below.

TABLE 1

| Sample No. | Polyol | Acid | Alcohol |
|---|---|---|---|
| 1 | Neopentyl glycol | adipic | 3,5,5-trimethyl-1-hexanol |
| 2 | Neopentyl glycol | adipic | 3,5,5-trimethyl-1-hexanol |
| 3 | Trimethylolpropane | adipic | a branched $C_7$ alcohol |
| 4 | Trimethylolpropane | adipic | a branched $C_8$ alcohol |

Sample 1 is a complex alcohol ester formed from the reaction product of neopentyl glycol, adipic acid and 3,5,5-trimethyl-1-hexanol in a ratio of 1:2.3:2.99. Sample 2 is a complex alcohol ester formed from the reaction product of neopentyl glycol, adipic acid and 3,5,5-trimethyl-1-hexanol in a ratio of 1:2.6:3.66. Sample 3 is a complex alcohol ester based on trimethylolpropane, adipic acid and a branched $C_7$ alcohol wherein some diisooctyl adipate (DIOA) is formed during the esterification produce. Sample 4 is a complex alcohol ester based on trimethylolpropane, adipic acid and a branched $C_8$ alcohol, and DIOA.

TABLE 2

| Sample No. | Stability (ASHRAE 97) |
|---|---|
| 1 | stable |
| 2 | stable |
| 3 | marginally stable |
| 4 | marginally stable |

As can be seen from these data, the complex alcohol esters based on neopentyl glycol/adipic acid/3,5,5-trimethyl-1-hexanol exhibit excellent stability.

EXAMPLE 4

Complex alcohol esters were prepared by reacting a polyol, a dicarboxylic acid, and 3,5,5-trimethyl-1-hexanol, in the molar ratios given in Table 3 below, in the presence of a catalyst. After reaction was complete, the catalyst was removed and excess alcohol stripped from the crude product. Filtering produced the final product.

TABLE 3

| Polyol | Dicarboxylic Acid | Alcohol | Molar Ratio | HPDSC (min.) |
|---|---|---|---|---|
| NPG | Adipic Acid | 3,5,5-trimethyl-1-hexanol | 1:2.0:2.64 | 5.6 |
| NPG | Adipic Acid | 3,5,5-trimethyl-1-hexanol | 1:2.3:3.38 | 44.3 |
| NPG | Adipic Acid | 3,5,5-trimethyl-1-hexanol | 1:1.75:2.6 | 48.9 |
| TMP | Adipic Acid | 3,5,5-trimethyl-1-hexanol | 1:3.0:3.9 | 76.9 |
| TMP | Adipic Acid | 3,5,5-trimethyl-1-hexanol | 1:3.3:3.9 | 76.9 |
| TMP | Adipic Acid | 3,5,5-trimethyl-1-hexanol | 1:2.63:3.89 | 66.7 |

NPG denote neopentyl glycol.
TMP denotes trimethylolpropane.

As the data set forth above demonstrate, complex alcohol esters exhibit exceptional oxidative stability as measured by HPDSC. They are significantly more stable than simple esters and even most polyol esters.

EXAMPLE 5

Complex alcohol esters were made using both trimethylolpropane and technical grade pentaerythritol as the polyol, adipic acid as the polybasic acid and various $C_7$–$C_{13}$ monohydric alcohols, both linear and branched. During the reaction, the adipate di-ester was also formed. Some of these materials were wipefilmed to remove the adipate di-ester and some were not. The products were submitted for various tests.

One particularly surprising result was in regard to seal swell. Diisodecyladipate (DIDA) has been found to be particularly harsh on some seals.

Samples containing as much as 40% DIDA demonstrated the same seal swell as samples of diisotridecyladipate (DTDA), which is used as a commercial lubricant today because of its low seal swell.

TABLE 4

| Ester | Pour Point (°C.) | Viscosity at −25° C. (cPs) | 40° C. (cSt) | 100° C. (cst) | Viscosity Index | HPDSC OIT* (min.) | Biodegradability (%) |
|---|---|---|---|---|---|---|---|
| TMP/AA/IDA | — | — | 165.7 | 21.31 | 152 | — | 67 |
| TMP/AA/IHA | −33 | 43500 | 155.6 | 18.22 | 131 | — | 81 |
| TPE/AA/IHA | — | — | 160.8 | 24.35 | 184 | 58.83 | 85 |
| TMP/iso-$C_{18}$ | −20 | 358000 | 78.34 | 11.94 | 147 | — | 63 |

*OIT denotes oxidation induction time (minutes until decomposition)
HPDSC denotes high pressure differential calorimetry
TMP is trimethylolpropane
AA is adipic acid
IDA is isodecyl alcohol
IHA is isohexyl alcohol
TPE is technical grade pentaerythritol
iso-$C_{18}$ is isostearate

EXAMPLE 6

Set forth below in Table 6 are various samples where the complex alcohol esters of the present invention were blended with various other polyol esters and then run through a Yamaha 2T test to determine lubricity of the blends.

TABLE 6

(Lubricity Data)

| Ester Blend | Blend Ratio | Reference | Sample |
|---|---|---|---|
| TPE/C810/Ck8:TMP/7810 | 1:1 | 6.00 | 5.92 |
| TMP/AA/DA:TMP/1770 | 2:3 | 5.54 | 5.18 |

C810 is a mixture of linear $C_8$ and $C_{10}$ acids.
Ck8 is an iso-octyl alcohol formed from the cobalt oxo process.
7810 is a mixture of n-$C_7$, n-$C_8$, and n-$C_{10}$ acids.
1770 is a mixture of n-$C_7$ and α-branched $C_7$, respectively.

EXAMPLE 7

High viscosity complex alcohol esters according to the present invention were synthesized by reacting one mole of trimethylolpropane with three moles of succinic anhydride and after they were fully reacted (as shown by exothermic heat increase) the resultant polybasic acid was esterified with excess isodecyl alcohol using titanium tetraisopropoxide as the esterification catalyst. The crude reactor provided was neutralized, flash dried, filtered and the excess isodecyl alcohol was stripped from the reactor product.

The finished complex alcohol ester composition had a specific gravity of 1.013, a viscosity of 24.2 cSt at 40° C., a viscosity of 260.9 cSt at 100° C., and a viscosity index of 117.

EXAMPLE 8

Complex alcohol esters when heat soaked in closed systems at 180° C., 200° C. and 225° C., respectively, exhibited slight increases (approximately 1.5% to 10%) in their viscosities at 40° C. and 100° C. This viscosity data was obtained for a complex alcohol ester that had a hydroxyl number of 17.5. When a very similar complex alcohol ester with a much lower hydroxyl number of 3.7 is identically heated, it exhibited no significant increase in viscosity.

The latter, low hydroxyl complex alcohol ester was produced by using a different adipic acid to trimethylolpropane feed ratio than the high hydroxyl ester.

Six esterifications at different excesses of isodecyl alcohol and adipic acid to trimethylolpropane molar ratios were carried out using a one step process in which tetraisopropyl titanate catalyst was added (at a 0.0005 catalyst to adipic acid ratio) at between 89 and 91% conversion. They were finished by simply hydrolyzing with 2 weight percent water at 90° C. for 2 hours, filtering, and stripping. It was found that as the adipic acid to trimethylolpropane molar ratio increased and the percent excess isodecyl alcohol decreased, the resulting hydroxyl number of the product decreased. Thus, when an adipic acid to trimethylolpropane ratio of 3.0 and 10% excess isodecyl alcohol were used, the complex alcohol ester produced had a 3.7 hydroxyl number.

EXAMPLE 9

The complex alcohol esters of the present invention were form by the unique process according to the present invention wherein the catalyst is only added after approximately 90% conversion had been achieved. These esters were compared to esters formed when the catalyst was added at the outset of the esterification reaction.

Accordingly, trimethylolpropane, adipic acid and either isononyl or isodecyl alcohol were reacted in a molar ratio of 1:3:3.75 in a single stage or two stage reaction process until 99.5% conversion was reached. The metal catalysts were removed by treatment with aqueous sodium carbonate, followed by flashing off of the water present, and filtration. The metals analysis of the resulting products are set forth below in Table 7.

TABLE 7

| Catalyst | Number of Reaction Steps | Time of Catalyst Addition | Catalyst Metal in Product (ppm) |
|---|---|---|---|
| Stannous Oxalate | 2 | 0%* | 473 |
| Stannous Oxalate | 2 | 88–90%** | 6 |
| Stannous Oxalate | 1 | 90%** | less than 1.9 |

*Catalyst was added at the outset of the esterification reaction before any conversion of the reaction products to the desired complex alcohol ester.
**Catalyst was added after the designated amount of conversion of the reaction products to the desired complex alcohol ester.

EXAMPLE 10

Trimethylol propane, adipic acid and isodecyl alcohol were reacted in a two stage reaction with a tetraisopropyl titanate catalyst added after 90% of the hydroxyl functionalities were esterified. The reaction was continued until 99.7% conversion was reached. The metal catalyst was then removed by treatment with 2% water for two hours at either 90° C. and atmospheric pressure or 145° C. and 0.5 MPa (60 psig), followed by flashing off of the water, and filtration. The titanium analysis of the two resulting products were 52 ppm for the former and 1.7 ppm for the latter.

EXAMPLE 11

In all eighteen (18) basestocks were tested by the present inventors. The basestocks included herein are as follows:

| | |
|---|---|
| Adipates: | DIDA, DTDA |
| Polyalphaolefins: | PAO 4, PAO 6, PAO 40, PAO 100 |
| Polyisobutylenes: | PSP 5, Parapol 450, Parapol 700, Parapol 950 |
| Polyol esters: | TMP ester of n-$C_7$, n-$C_8$ and n-$C_9$ acids, TMP ester of 3,5,5-trimethylhexanoic acid, TechPE ester of iso-$C_8$, n-$C_8$ and n-$C_{10}$ acids, TechPE ester of iso-$C_8$ and 3,5,5-trimethylhexanoic acids. |
| Complex Alcohol Esters: | TMP/AA/IDA in a ratio of 1:3:3, TMP/AA/TMH in a ratio of 1:3:3. |

DIDA denotes diisodecyladipate.
DTDA dendtes diisotridecyladipate
TMP denotes trimethylolpropane
TechPE denotes technical grade pentaerythritol.
AA denotes adipic acid.
IDA denotes isodecyl alcohol.
TMH denotes 3,5,5-trimethyl-1-hexanol.

In addition, two basestocks from Akzo, i.e., Ketjenlube 1300 and copolymers of maleic esters and alphaolefins, were also tested.

The tests that were used, and a brief description of each test, are as follows:

HPDSC—High Pressure Differential Scanning Calorimetry. A comparative measure of the thermal/oxidative stability of a sample. The HPDSC is run at 220° C. under a pressure of 500 psi of air, the sample being tested containing 0.5 wt. % Vanlube-81, an antioxidant. The time to onset of decomposition is measured. Higher stability is indicated by longer onset of decomposition times.

ASTM D-2272—Oxidation Stability of Steam Turbine Oils by Rotating Bomb (RBOT). An oxidative stability test in which the sample, a small amount of water, and a copper catalyst coil are charged to a bomb, pressured to 90 psi with oxygen at room temperature, then heated to 150° C. The time it takes for the sample to absorb a set amount of oxygen after reaching temperature is measured. As with the HPDSC, longer times indicate higher stability.

ASTM D-2893—Oxidation Characteristics of Extreme Pressure Lubrication Oils. The oil is subjected to a temperature of 95° C. in a flow of dry air for 312 hours. Changes in viscosity of the oil are measured, and the formation of precipitates and changes in color are also noted. According to this test, the smallest changes in viscosity indicate the most stable materials.

ASTM D-2783—Measurement of Extreme-Pressure Properties of Lubricating Fluids (Four-Ball Method). This test measures the load carrying characteristics of an oil. As a measure of this, the load wear index is calculated, which is an index of the ability of a lubricant to minimize wear. The higher the load wear index, the better the load carrying characteristics of the oil (again, a higher seizure load equates to better load carrying characteristics).

ASTM D-4172—Wear Preventive Characteristics of a Lubricating Fluid (Four-Ball Method). This is a procedure for making a "preliminary evaluation of the anti-wear properties of fluid lubricants in sliding contact." Under standard conditions (75° C., 1200 rpm, 40 kg load, 1 hour), a single steel ball is rotated against three other stationary steel balls, these last three balls being covered with the test lubricant. The average size of the scar diameters worn on the three stationary balls is a measure of the wear characteristics of the oil. The coefficient of friction, that is, the ratio of the force required to move the one rotating ball over the other three to the total force pressing the balls together, can also be determined by measuring the torque required to rotate the top ball.

ASTM D-5621—Sonic Shear Stability of Hydraulic Fluid. Evaluates the shear stability of oil by measuring changes in viscosity that result from irradiating a sample in a sonic oscillator.

The results are contained in Tables 8–11. Table 8 covers the results from thermal/oxidative stability tests. Table 9 contains the data from the wear test D-2783, while Table 10 covers the wear and friction data from D4172. Finally, the sonic shear test results are contained in Table 11.

TABLE 8

| Basestock | HPDSC (Min) | RBOT (Min) | ASTM D-2893 Oxidative Stability Viscosity Change |
|---|---|---|---|
| DIDA | 6.04 | 16 | +46.61 |
| DTDA | 3.88 | 84 | +0.93 |
| PAO 4 | 3.O5 | 24 | +17.39 |
| PAO 6 | 3.06 | 24 | +10.58 |
| PAO 40 | 3.05 | 24 | +25.94 |
| PAO 100 | 2.61 | 25 | +16.90 |
| PSP 5 | — | 9 | +1290.28 |
| Parapol 450 | 1.90 | 13 | +107.53 |
| Parapol 700 | 2.37 | 15 | +53.12 |
| Parapol 950 | 2.68 | 18 | +18.82 |
| TMP/n-$C_7$,$C_8$,$C_9$ acids | 17.7 | 121 | +0.25 |
| TMP/iso-$C_9$ acid | 118.6 | 193 | +1.28 |
| TechPE/iso-$C_8$, $C_8$,$C_{10}$ | 12.7 | 83 | +2.97 |
| TechPE/iso-$C_8$,$C_9$ acids | 58.7 | 120 | +1.22 |
| TMP/AA/IDA | 14.8 | 32 | +37.06 |
| TMP/AA/TMH | 66.7 | 343 | +1.26 |
| Ketjenlube 1300 | 20.1 | 69 | +41.70 |
| Ketjenlube 2300 | 11.7 | 59 | +32.81 |

All eighteen oils were tested for thermal/oxidative stability using three different tests, i.e., high pressure differential scanning calorimetry (HPDSC), rotating bomb oxidation test (RBOT, AST D-2272), and oxidation characteristics of extreme pressure lubricants (ASTM D-2893).

The primary purpose of these tests was to evaluate the complex alcohol esters of the present invention versus other conventional basestocks now used in synthetic oils. In that respect, the general conclusion is that the complex alcohol ester basestocks of the present invention are at least equivalent, in terms of stability, to those basestocks now being used.

The data obtained from the various lubricity/wear tests are set forth below in Tables 9 and 10. The output from the ASTM D-2783 test is the load wear index, a calculated number that is a relative measure of the load carrying characteristics of the oil. The higher the load wear index, the higher the load the oil is able to carry without showing significant wear.

The present inventors discovered that the load wear index is a function of viscosity. Thus, a more viscous liquid is typically able to support a heavier load, and the results set forth below in Tables 9 and 10 confirm this general observation. It is also obvious that viscosity is not the sole determinant of load carrying characteristics. Looking at the data, it is obvious that, as a class of compounds, the complex alcohol esters show significantly higher load wear indices than would be predicted by viscosity alone.

Load Wear Index for Complex Esters

| Ester | Viscosity @ 100° C., cSt Actual | Predicted | Load Wear Index Actual | Predicted |
|---|---|---|---|---|
| TechPE/AA/IDA | 14.8 | 115 | 24.47 | 17.3 |
| TMP/AA/TMH | 11.0 | 100 | 23.39 | 17.1 |

As can be seen from the table above, the complex alcohol esters of the present invention behave as if they are more viscous than the actually are. Thus, their predicted load wear index, based on their viscosity, is much less than the load wear index actually measured. Likewise, the viscosity predicted based on the measured load wear index is much higher than the viscosity actually measured for these materials, as much as 4 to 10 times higher than the measured viscosity.

The reason for the high load wear index of the complex alcohol esters of the present invention has to do with the oligomeric nature of these materials. All are a mix of products, ranging from very light materials (the adipates in the case of complex alcohol esters) to very heavy components. This mix of light and heavy components results in both the viscosities and load wear indices found in this Example. The presence of light components, which in the case of the complex alcohol esters can be quite large, depresses the viscosity to give the relatively low values measured. At the same time, the presence of the very heavy, very high viscosity components imparts good wear characteristics to these complex alcohol esters, resulting in the very good wear characteristics seen in this test.

TABLE 9

(ASTM D-2783 Load Wear Index)

| Basestock | Viscosity cSt @ 100° C. | Load Wear Index |
|---|---|---|
| DIDA | 3.6 | 15.66 |
| DTDA | 5.4 | 17.54 |
| PAO 4 | 4.0 | 16.72 |
| PAO 6 | 6.0 | 16.69 |
| PAO 40 | 40 | 20.91 |
| PAO 100 | 100 | 25.53 |
| PSP 5 | less than 1.0 | 10.75 |
| Parapol 450 | 10 | 13.50 |
| Parapol 700 | 78 | 20.84 |
| Parapol 950 | 219 | 21.20 |
| TMP/n-$C_7$,$C_8$,$C_9$ acids | 4.0 | 17.16 |
| TMP/iso-$C_9$ acid | 7.1 | 15.76 |
| TechPE/iso-$C_8$, n-$C_8$,n-$C_{10}$ | 6.7 | 17.88 |
| TechPE/iso-$C_8$,$C_9$ acids | 10.7 | 19.60 |
| TMP/AA/IDA | 14.8 | 24.47 |
| TMP/AA/TMH | 11.0 | 23.39 |
| Ketjenlube 1300 | 260 | 40.00 |
| Ketjenlube 2300 | 300 | 40.29 |

Similar results are obtained via the ASTM D-4 172 test set forth in Table 10 below, i.e., decreasing wear and coefficient of friction with increasing viscosity. The results based on the coefficient of friction are very surprising. The complex alcohol esters of the present invention demonstrated very good lubricity, much better than their wear characteristics. It is believed that these complex alcohol esters create a very "greasy" surface, but the thickness of the layer is too thin to give a proportionate decrease in wear. The very heavy components most likely impart very good wear and lubricity characteristics, but, at least in the case of wear, are diluted to some extent by the very light components.

TABLE 10

(ASTM D-4172 Four-Ball Wear)

| Basestock | Viscosity cSt @ 100° C. | Wear Scar (mm) | Coefficient of Friction (average) |
|---|---|---|---|
| DIDA | 3.6 | 0.91 | 0.067 |
| DTDA | 5.4 | 0.74 | 0.111 |
| PAO 4 | 4.0 | 0.88 | 0.089 |
| PAO 6 | 6.0 | 0.67 | 0.092 |
| PAO 40 | 40 | 0.80 | 0.084 |
| PAO 100 | 100 | 0.70 | 0.100 |
| PSP 5 | — | 0.95 | 0.137 |
| Parapol 450 | 10 | 0.67 | 0.111 |
| Parapol 700 | 78 | 0.70 | 0.105 |
| Parapol 950 | 219 | 0.71 | 0.107 |
| TMP/n-$C_7$,$C_8$,$C_9$ acids | 4.0 | 0.66 | 0.096 |
| TMP/iso-$C_9$ acid | 7.1 | 0.91 | 0.090 |
| TechPE/iso-$C_8$, n-$C_8$,n-$C_{10}$ | 6.7 | 0.68 | 0.087 |
| TechPE/iso-$C_8$,$C_9$ acids | 10.7 | 0.94 | 0.122 |
| TMP/AA/IDA | 14.8 | 0.60 | 0.051 |
| TMP/AA/TMH | 11.0 | 0.59 | 0.056 |
| Ketjenlube 1300 | 260 | 0.32 | 0.051 |
| Ketjenlube 2300 | 300 | 0.50 | 0.061 |

Shear stability results are given in Table 11 below. The complex alcohol esters show very little viscosity loss under shear. For comparison purposes, the shear stability of two Ketjenlube samples was also determined. Similar results were obtained. Thus, it does not appear that shear stability of the complex alcohol esters of the present invention is a problem.

TABLE 11

(ASTM D-5621 Sonic Shear)

| Basestock | Initial Viscosity cSt @ 40° C. | Sheared Viscosity cSt @ 40° C. | % Loss |
|---|---|---|---|
| TMP/AA/IDA | 103.45 | 102.77 | 0.66 |
| TMP/AA/TMH | 71.08 | 70.53 | 0.63 |
| Ketjenlube 1300 | 4178.34 | 4076.03 | 2.45 |
| Ketjenlube 2300 | 3007.73 | 3781.41 | 0.69 |

Fuel economy improvement is a major driver in the performance of top of the line engine oils. At a given viscosity grade, changes in basestock composition can provide differences in fuel economy as measured by such tests as the Ford Sigma test and the M 111 test. Results to date in both test systems using an oil comprising all of the components of ULTRON engine oil (i.e., a polyalphaolefin ester basestock) without molybdenum and varying the ester component and ester treat rate indicates that complex alcohol esters provide surprisingly good fuel economy improvement results. Tables 12 and 13 below summarize the data:

TABLE 12

(Ford Sigma Test Results)

| Oil | Viscosity Grade | ppm MO* | % FEI** |
|---|---|---|---|
| Base case (no ester) | 5W40 | 0 | 1.6 |
| Base case + 10% TMP810 | 5W30 | 100 | 1.7 |
| Base case + 10% CALE | 0W30 | 0 | 2.9 |

*designates molybdenum.
**designates percent fuel economy improvement.
TMP810 designates an ester formed from the reaction product of trimethylol propane and linear $C_8$, $C_9$ and $C_{10}$ acids.
CALE is an ester formed from the reaction product of trimethylol propane, adipic acid and isodecyl alcohol having a total acid number of 1.0, a hydroxyl number of 18 mg (KOH/gram sample), a metal (titanium) content of 1.7 ppm and a Flash Point of 465° F.

TABLE 13

(M 111 Test Result)

| Oil | Viscosity Grade | % CALE | % FEI** | HTHS |
|---|---|---|---|---|
| Reference Oil | 5W20 | 0 | 2.4–2.8 | 2.7 |
| Ultron* | 5W30 | 5 | 2.0 | 3.07 |
| Ultron* | 5W30 | 10 | 2.5 | 3.07 |
| Ultron* | 5W30 | 15 | 3.5 | 3.08 |

*Ultron is a polyalphaolefin.
**designates percent fuel economy improvement.
CALE is an ester formed from the reaction product of trimethylol propane, adipic acid and isodecyl alcohol having a total acid number of 1.0, a hydroxyl number of 18 mg (KOH/gram sample), a metal (titanium) content of 1.7 ppm and a Flash Point of 465° F.

As demonstrated above in Tables 12 and 13, blending of other hydrocarbon-based or synthetic oils with the complex alcohol ester according to the present invention results in a dramatic increase in the percent fuel economy improvement compared to the hydrocarbon-based or synthetic oils along or in combination with other ester basestocks.

EXAMPLE 13

Set forth below in Table 14 are comparative data which show the benefit of adding complex alcohol esters to a GF-3 mineral oil basestock versus molybdenum addition or complex alcohol ester with molybdenum.

TABLE 14

(Sequence YIA Screener Test)

| Mineral Oil | MO* (ppm) | CALE | % FEI** |
|---|---|---|---|
| GF-3 | 500 | 0 | 1.3479 |
| GF-3 | 0 | 5% | 1.4084 |
| GF-3 | 100 | 5% | 1.2421 |

*MO designates molybdenum
**designates percent fuel economy improvement.
CALE is an ester formed from the reaction product of trimethylol propane, adipic acid and isodecyl alcohol having a total acid number of 1.0, a hydroxyl number of 18 mg (KOH/gram sample), a metal (titanium) content of 1.7 ppm and a Flash Point of 465° F.

What is claimed is:

1. A process for improving the fuel economy of a vehicle powered by an internal combustion engine having a crankcase, which comprises:

adding to said crankcase a lubricating oil which comprises an add mixture of the following components: a complex alcohol ester basestock which is a reaction product of an add mixture of the following: (1) a polyhydroxyl compound selected from the group consisting of neopentyl glycol, technical grade pentaerythritol, mono-pentaerytritol, di-pentaerythritol, trimethylolpropane, trimethylolethane and trimethylolbutane; (2) a polybasic acid or an anhydride of a polybasic acid, provided that the ratio of equivalents of said polybasic acid to equivalents of alcohol from said polyhydroxyl compound is in the range between about 1.6:1 and 2:1; and (3) a monohydric alcohol, provided that the ratio of equivalents of said monohydric alcohol to equivalents of said polybasic acid is in the range between about 0.84:1 and 1.2:1; wherein said complex alcohol ester exhibits a viscosity in the range between about 100–700 cSt at 40° C. and has a polybasic acid ester concentration of less than or equal to 70 wt. %, based on said complex alcohol ester, and at least one additional basestock; and operating said internal combustion engine wherein said lubricating basestock oil exhibits a percent fuel economy improvement in the range between about 0.3 to 5.0%, versus said lubricating oil without said complex alcohol ester basestock.

2. The process according to claim 1 wherein said complex alcohol ester basestock is added in an amount such that said lubricating oil exhibits a lubricity, as measured by the coefficient of friction, of less than or equal to 0.15.

3. The process according to claim 1 wherein said complex alcohol ester exhibits the following properties: lubricity, as measured by the coefficient of friction, of less than or equal to 0.1; a pour point of less than or equal to −20° C.; biodegradability of greater than 60%, as measured by the Sturm test; an aquatic toxicity of greater than 1,000 ppm; no volatile organic components; and thermal/oxidative stability as measured by HPDSC at 220° C. and 3.445 MPa air of greater than 10 minutes.

4. The process according to claim 1 wherein said lubricating oil passes the Yamaha Tightening Test, exhibits a FZG of greater than about 12, and/or exhibits a wear scar diameter of less than or equal to 0.45 millimeters.

5. The process according to claim 1 wherein said additional basestock is selected from the group consisting of: natural oils, hydrocarbon-based oils and synthetic oils.

6. The process according to claim 5 wherein said mineral oils are at least one oil selected from the group consisting of: rapeseed oils, canola oils and sunflower oils; said hydrocarbon-based oils are at least one oil selected from the group consisting of: mineral oils and highly refined mineral oils; and said synthetic oils are at least one oil selected from the group consisting of: poly alpha olefins, polyalkylene glycols, polyisobutylenes, phosphate esters, silicone oils, diesters, polyol esters, and other synthetic esters.

7. The process according to claim 1 wherein said complex alcohol ester basestock is present in an amount between about 0.5–35 wt. % and said additional basestock is present in an amount between about 65–99.5 wt. %.

8. The process according to claim 7 wherein said complex alcohol ester basestock is present in an amount between about 1–15 wt. % and said additional basestock is present in an amount between about 85–95 wt. %.

9. The process according to claim 3 wherein said complex alcohol ester basestock has a pour point of less than or equal to −40° C.

10. The process according to claim 1 wherein said polyhydroxyl compound is at least one compound selected from the group consisting of: technical grade pentaerythritol and mono-pentaerythritol, and the ratio of equivalents of said polybasic acid to equivalents of alcohol from said polyhydroxyl compound is in the range between about 1.75:1 to 2:1.

11. The process according to claim 1 wherein said polyhydroxyl compound is at least one compound selected from the group consisting of: trimethylolpropane, trimethylolethane and trimethylolbutane, and the ratio of equivalents of said polybasic acid to equivalents of alcohol from said polyhydroxyl compound is in the range between about 1.6:1 to 2:1.

12. The process according to claim 1 wherein said polyhydroxyl compound is di-pentaerythritol and the ratio of equivalents of said polybasic acid to equivalents of alcohol from said polyhydroxyl compound is in the range between about 1.83:1 to 2:1.

13. The process according to claim 1 wherein viscosity of said complex alcohol ester is in the range between about 100–200 cSt at 40° C.

14. The process according to claim 1 wherein said monohydric alcohol may be at least one alcohol selected from the group consisting of: branched and linear $C_5$ to $C_{13}$ alcohol.

15. The process according to claim 14 wherein said linear monohydric alcohol is present in an amount between about 0 to 30 mole %.

16. The process according to claim 15 wherein said linear monohydric alcohol is present in an amount between about 5 to 20 mole %.

17. The process according to claim 14 wherein said monohydric alcohol is at least one alcohol selected from the group consisting of: $C_8$ to $C_{10}$ iso-oxo alcohols.

18. The process according to claim 17 wherein said polybasic acid is adipic acid and said monohydric alcohol is either isodecyl alcohol or 2-ethylhexanol.

19. The process according to claim 1 wherein said complex alcohol ester basestock exhibits at least one of the properties selected from the group consisting of:

(a) a total acid number of less than or equal to about 1.0 mgKOH/gram, (b) a hydroxyl number in the range between about 3 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, (j) a viscosity index equal to or greater than about 150, and (k) an oxidative and thermal stability as measured by HPDSC at 220° C. of greater than about 10 minutes with about 0.5 wt. % of an antioxidant.

20. The process according to claim 5 wherein said additional basestock is said synthetic oil and said lubricating oil exhibits a percent fuel economy improvement of less than or equal to 3.5%, versus said lubricating oil without said complex alcohol ester basestock.

21. The process according to claim 5 wherein said additional basestock is said hydrocarbon-based oil and said lubricating oil exhibits a percent fuel economy improvement of between about 0.5 to 1.5%, versus said lubricating oil without said complex alcohol ester basestock.

22. A crankcase lubricant which comprises an add mixture of the following components:

a lubricating oil which comprises an add mixture of the following components: a complex alcohol ester basestock which is a reaction product of an add mixture of the following: (1) a polyhydroxyl compound selected from the group consisting of neopentyl glycol, technical grade pentaerythritol, mono-pentaerytritol, di-pentaerythritol, trimethylolpropane, trimethylolethane and trimethylolbutane; (2) a polybasic acid or an anhydride of a polybasic acid, provided that the ratio of equivalents of said polybasic acid to equivalents of alcohol from said polyhydroxyl compound is in the range between about 1.6:1 and 2:1; and (3) a monohydric alcohol, provided that the ratio of equivalents of said monohydric alcohol to equivalents of said polybasic acid is in the range between about 0.84:1 and 1.2:1; wherein said complex alcohol ester exhibits a viscosity in the range between about 100–700 cSt at 40° C. and has a polybasic acid ester concentration of less than or equal to 70 wt. %, based on said complex alcohol ester, and at least one additional basestock; and an additive package; wherein said crankcase engine lubricant exhibits a percent fuel economy improvement in the range between about 0.3 to 5.0%, versus said lubricating oil without said complex alcohol ester basestock.

23. The lubricant according to claim 22 wherein said complex alcohol ester basestock is added in an amount such that said lubricating oil exhibits a lubricity, as measured by the coefficient of friction, of less than or equal to 0.15.

24. The lubricant according to claim 22 wherein said complex alcohol ester exhibits the following properties: lubricity, as measured by the coefficient of friction, of less than or equal to 0.1; a pour point of less than or equal to −20° C.; biodegradability of greater than 60%, as measured by the Sturm test; an aquatic toxicity of greater than 1,000 ppm; no volatile organic components; and thermal/oxidative stability as measured by HPDSC at 220° C. and 3.445 MPa air of greater than 10 minutes.

25. The lubricant according to claim 22 wherein said lubricating oil passes the Yamaha Tightening Test, exhibits a FZG of greater than about 12, and/or exhibits a wear scar diameter of less than or equal to 0.45 millimeters.

26. The lubricant according to claim 22 wherein said additional basestock is selected from the group consisting of: natural oils, hydrocarbon-based oils and synthetic oils.

27. The lubricant according to claim 26 wherein said mineral oils are at least one oil selected from the group consisting of: rapeseed oils, canola oils and sunflower oils; said hydrocarbon-based oils are at least one oil selected from the group consisting of: mineral oils and highly refined mineral oils; and said synthetic oils are at least one oil selected from the group consisting of: poly alpha olefins, polyalkylene glycols, polyisobutylenes, phosphate esters, silicone oils, diesters, polyol esters, and other synthetic esters.

28. The lubricant according to claim 22 wherein said complex alcohol ester basestock is present in an amount between about 0.5–35 wt. % and said additional basestock is present in an amount between about 65–99.5 wt. %.

29. The lubricant according to claim 28 wherein said complex alcohol ester basestock is present in an amount between about 1–15 wt. % and said additional basestock is present in an amount between about 85–95 wt. %.

30. The lubricant according to claim 24 wherein said complex alcohol ester basestock has a pour point of less than or equal to −40° C.

31. The lubricant according to claim 22 wherein said polyhydroxyl compound is at least one compound selected from the group consisting of: technical grade pentaerythritol and mono-pentaerythritol, and the ratio of equivalents of said polybasic acid to equivalents of alcohol from said polyhydroxyl compound is in the range between about 1.75:1 to 2:1.

32. The lubricant according to claim 22 wherein said polyhydroxyl compound is at least one compound selected from the group consisting of: trimethylolpropane, trimethylolethane and trimethylolbutane, and the ratio of equivalents of said polybasic acid to equivalents of alcohol from said polyhydroxyl compound is in the range between about 1.6:1 to 2:1.

33. The lubricant according to claim 22 wherein said polyhydroxyl compound is di-pentaerythritol and the ratio of equivalents of said polybasic acid to equivalents of alcohol from said polyhydroxyl compound is in the range between about 1.83:1 to 2:1.

34. The lubricant according to claim 22 wherein viscosity of said complex alcohol ester is in the range between about 100–200 cSt at 40° C.

35. The lubricant according to claim 22 wherein said monohydric alcohol may be at least one alcohol selected from the group consisting of: branched and linear $C_5$ to $C_{13}$ alcohol.

36. The lubricant according to claim 35 wherein said linear monohydric alcohol is present in an amount between about 0 to 30 mole %.

37. The lubricant according to claim 36 wherein said linear monohydric alcohol is present in an amount between about 5 to 20 mole %.

38. The lubricant according to claim 35 wherein said monohydric alcohol is at least one alcohol selected from the group consisting of: $C_8$ to $C_{10}$ iso-oxo alcohols.

39. The lubricant according to claim 38 wherein said polybasic acid is adipic acid and said monohydric alcohol is either isodecyl alcohol or 2-ethylhexanol.

40. The lubricant according to claim 22 wherein said complex alcohol ester basestock exhibits at least one of the properties selected from the group consisting of:

(a) a total acid number of less than or equal to about 1.0 mgKOH/gram, (b) a hydroxyl number in the range between about 3 to 50 mgKOH/gram, (c) a metal catalyst content of less than about 25 ppm, (d) a molecular weight in the range between about 275 to 250,000 Daltons, (e) a seal swell equal to about diisotridecyladipate, (f) a viscosity at −25° C. of less than or equal to about 100,000 cps, (g) a flash point of greater than about 200° C., (h) aquatic toxicity of greater than about 1,000 ppm, (i) a specific gravity of less than about 1.0, (j) a viscosity index equal to or greater than about 150, and (k) an oxidative and thermal stability as measured by HPDSC at 220° C. of greater than about 10 minutes with about 0.5 wt. % of an antioxidant.

41. The lubricant according to claim 26 wherein said additional basestock is said synthetic oil and said lubricating oil exhibits a percent fuel economy improvement of less than or equal to 3.5%, versus said lubricating oil without said complex alcohol ester basestock.

42. The lubricant according to claim 26 wherein said additional basestock is said hydrocarbon-based oil and said lubricating oil exhibits a percent fuel economy improvement of between about 0.5 to 1.5%, versus said lubricating oil without said complex alcohol ester basestock.

* * * * *